US007044580B2

(12) United States Patent
Kimura

(10) Patent No.: US 7,044,580 B2
(45) Date of Patent: May 16, 2006

(54) INK JET RECORDING HEAD MAINTENANCE APPARATUS AND INK JET RECORDING APPARATUS

(75) Inventor: Kazuhisa Kimura, Hiratsuka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 219 days.

(21) Appl. No.: 10/716,899

(22) Filed: Nov. 18, 2003

(65) Prior Publication Data

US 2005/0104925 A1 May 19, 2005

(51) Int. Cl.
*B41J 2/165* (2006.01)

(52) U.S. Cl. ..... 347/33; 347/29; 347/32

(58) Field of Classification Search ..... 347/22–35
See application file for complete search history.

(56) References Cited

U.S. PATENT DOCUMENTS

| | | | | |
|---|---|---|---|---|
| 4,380,770 | A | 4/1983 | Maruyama | |
| 4,829,318 | A | 5/1989 | Racicot et al. | |
| 5,126,765 | A | 6/1992 | Nakamura | |
| 5,231,424 | A | 7/1993 | Kaneko et al. | |
| 5,534,897 | A * | 7/1996 | Anderson et al. | 347/32 |
| 5,543,826 | A | 8/1996 | Kuronuma et al. | |
| 5,557,306 | A | 9/1996 | Fukushima et al. | |
| 5,612,722 | A | 3/1997 | Francis et al. | |
| 5,699,095 | A | 12/1997 | Mitsuzawa et al. | |
| 5,706,038 | A | 1/1998 | Jackson | |
| 5,793,390 | A | 8/1998 | Claflin et al. | |
| 5,805,180 | A | 9/1998 | Ebisawa et al. | |
| 5,886,714 | A | 3/1999 | Burnet et al. | |
| 5,953,025 | A | 9/1999 | Sakurai | |
| 6,000,792 | A | 12/1999 | Koizumi et al. | |
| 6,024,432 | A | 2/2000 | Aruga et al. | |
| 6,120,126 | A | 9/2000 | Nakahara | |
| 6,260,944 | B1 | 7/2001 | Mochizuki et al. | |
| 6,283,573 | B1 | 9/2001 | Nakamura | |
| 6,334,662 | B1 | 1/2002 | Hollands | |
| 6,386,677 | B1 | 5/2002 | Imai et al. | |
| 6,550,890 | B1 | 4/2003 | Saijo | |
| 6,631,974 | B1 * | 10/2003 | Shindo | 347/33 |
| 6,637,855 | B1 | 10/2003 | Ide et al. | |
| 6,641,247 | B1 | 11/2003 | Ide et al. | |

(Continued)

FOREIGN PATENT DOCUMENTS

EP 0 318 329 A2 5/1989

(Continued)

OTHER PUBLICATIONS

Related U.S. Appl. No. 10/465,112, filed Jun. 19, 2003; Invemtor: Hideaki Nishida et al.; Title: Ink Jet Head Cleaning Apparatus and Ink Jet Recording Apparatus.

(Continued)

*Primary Examiner*—Shih-Wen Hsieh
(74) *Attorney, Agent, or Firm*—Frishauf, Holtz, Goodman & Chick, P.C.

(57) ABSTRACT

An ink jet recording head maintenance apparatus of this invention is provided with a plurality of wiping members having different wiping forces to remove residual ink or foreign substances from the nozzle face of the nozzle plate of the recording head. When performing wiping operation, the optimum wiping member is selected from among the plurality of wiping members in accordance with a change in the kind of adhering substances and adhering condition. It is therefore possible to select the optimum wiping member and achieve a good wiping effect without increasing the number of counts of wiping operation.

18 Claims, 7 Drawing Sheets

U.S. PATENT DOCUMENTS

| | | | |
|---|---|---|---|
| 6,746,097 | B1 | 6/2004 | Im et al. |
| 2004/0100520 | A1 | 5/2004 | Kimura |
| 2004/0189735 | A1 | 9/2004 | Ishii et al. |
| 2004/0189741 | A1 | 9/2004 | Kimura et al. |
| 2004/0189742 | A1 | 9/2004 | Kimura et al. |

FOREIGN PATENT DOCUMENTS

| | | | |
|---|---|---|---|
| EP | 0 499 432 | A2 | 8/1992 |
| EP | 0 513 833 | A2 | 11/1992 |
| EP | 1 043 161 | A2 | 10/2000 |
| JP | 62-101448 | A | 5/1987 |
| JP | 02-006142 | | 1/1990 |
| JP | 02-095862 | A | 4/1990 |
| JP | 02-179757 | A | 7/1990 |
| JP | 03-099857 | A2 | 4/1991 |
| JP | 4-70355 | A | 3/1992 |
| JP | 05-201014 | A | 8/1993 |
| JP | 05-201028 | A | 8/1993 |
| JP | 05-220970 | A | 8/1993 |
| JP | 06-071904 | A | 3/1994 |
| JP | 06-135004 | A | 5/1994 |
| JP | 9-76517 | A | 3/1997 |
| JP | 2000-127417 | A | 5/2000 |
| JP | 2000-177113 | A | 6/2000 |
| JP | 10-119311 | A | 10/2000 |
| JP | 2000-280494 | A | 10/2000 |
| JP | 3161050 | B2 | 2/2001 |
| JP | 2001-219567 | A | 8/2001 |
| JP | 2001-260368 | A | 9/2001 |
| JP | 2002-283590 | A | 10/2002 |

OTHER PUBLICATIONS

U.S. Appl. No. 10/395,960, filed: Mar. 24, 2003; Inventors: Hidekazu Ishii et al; Title: Ink Jet Cleaning Apparatus and Ink Jet Recording Apparatus, Abdned.

U.S. Appl. No. 10/396,307, filed: Mar. 25, 2003; Inventors: Kazuhisa Kimura et al; Title: An Ink Jet Recording Apparatus Having Cleaning Means for the Cleaning of the Nozzle Surface of an Ink Jet Head, pending.

U.S. Appl. No. 10/403,091, filed Apr. 1, 2003; Inventor: Kazuhisa Kimura; Title: Image Recording Apparatus and Maintenance Method of Recording Head of the Same, patented pat#6,811,244.

Merriam-Webster's Collegiate Dictionary, 10th Edition, p. 611.

* cited by examiner

INK JET RECORDING HEAD MAINTENANCE APPARATUS AND INK JET RECORDING APPARATUS

BACKGROUND OF THE INVENTION

1. Field of the Invention

This invention relates to an ink jet recording head maintenance apparatus and more particularly to a maintenance apparatus of an ink jet recording head which ejects drops of ink drops through a nozzle provided in a nozzle plate, and an ink jet recording apparatus having the maintenance apparatus.

2. Discussion of the Background

There has been in widespread use an ink jet recording apparatus which performs printing by selectively ejecting ink drops to a recording medium from a plurality of nozzles arranged in a nozzle plate. In such an ink jet recording apparatus, the ink is likely to remain around the nozzles after the ejection of ink drops. The ink thus remaining, if dried/solidified, will cause deviation of direction of ink ejection or blocking of nozzles, and accordingly, defective ink ejection and defective printing are easy to occur. Furthermore, foreign substances such as dusts on the recording medium and dusts in the air will attach around the nozzles, similarly causing the deviated direction of ink ejection and the blocked nozzles to consequently result in the defective ink ejection and defective printing.

Therefore, there have been conventionally proposed various kinds of ink jet recording apparatus designed to remove ink or foreign substances remaining around the nozzles. For example, there has been proposed the technology that, with a wiping member formed of an elastic material or other pressed against the nozzle plate (a nozzle face of the nozzle plate), the wiping member is slid on the nozzle plate in this state to thereby wipe off the foreign substances holding on the nozzle plate. Furthermore, in Japanese Unexamined Patent Publications No. 2001-219567 and No. 2002-283590, there has been disclosed the technology that an improved adhering substance wiping effect is achieved by using a single wiping member at an increased wiping frequency. Furthermore, to achieve the adhering substance wiping effect, there has been disclosed the technology in Japanese Unexamined Patent Publication No. 2000-127417 that a groove is formed in a single wiping member to enable adjusting the angle of contact of the wiping member in relation to the nozzle face by utilizing the elastic deformation of the wiping member.

Furthermore, in Japanese Unexamined Patent Publication No. Hei 9-76517, there has been disclosed the technology that the optimum wiping effect is gained by setting the rubber hardness of a single wiping member within the range of 40 to 60 degrees of A Hardness specified in JIS K6301. Furthermore, to ensure the same wiping force of the wiping member notwithstanding a change in a distance between the recording head and the recording medium, a technology is disclosed that has achieved the wiping effect by the optimum arrangement of a plurality of wiping members of different free length and thickness so that the amount of deflection of the wiping member and the angle of contact of the wiping member with the nozzle face will vary in synchronization with a change in a distance between the recording head and the recording medium, in Japanese Unexamined Patent Publication No. 2000-177113.

The single wiping member, however, sometimes fails to properly function in response to a change in the kind of adhering substances (ink, fine particles of paper, dusts, etc.) or change in the substance conditions (e.g., an increase in ink adhesion caused by environmental changes, and an increase in ink adhesion by the length of time when ink deposit is left unremoved). The increased wiping frequency of the single wiping member, as previously stated for example in Japanese Unexamined Patent Publications No. 2001-219567 and No. 2002-283590, can remove a firmly adhering substance only to some extent. It becomes necessary to improve the wiping operating force of the wiping member, which, however, will further increase the wiping frequency, causing such drawbacks as an easy-to-abrade wiping member, a shortened wiping member life, and consequently a deteriorated wiping effect.

Furthermore, setting the rubber hardness of the single wiping member within 40 to 60 degrees of A Hardness specified in JIS K6301 as stated in Japanese Unexamined Patent Publication No. Hei 9-76517, the wiping member will not be applicable to the case where a greater wiping operating force of the wiping member is needed. Furthermore, in Japanese Unexamined Patent Publication No. 2000-177113, although nearly the same wiping member operating force is adopted in accordance with the operating condition, application to a condition where the greater operating force of the wiping member is needed is not performed.

SUMMARY OF THE INVENTION

An object of this invention, therefore, is to achieve a good wiping effect by selecting the optimum wiping member without increasing the wiping frequency in case of a change in the kind of adhering substances (ink, fine particles of paper, dust, etc.) and a change in an adhering condition (an increase in ink adhesion caused by environmental changes, and an increase in ink adhesion caused by the length of time when ink deposit is left unremoved).

Another object of this invention is to prolong the life of the wiping member, and to maintain a good wiping performance of the wiping member for a prolonged period of time.

Another object of this invention is to maintain a good ink ejection performance at the time of printing for a prolonged period of time to thereby improve reliability of printing.

These objects of this invention are achieved by the provision of new ink jet recording head maintenance apparatus and ink jet recording apparatus of this invention.

Therefore, according to the new ink jet recording head maintenance apparatus and the ink jet recording apparatus, there are provided a plurality of wiping members at least one of which differs in the wiping force against the nozzle face, to thereby remove ink and foreign substances remaining on the nozzle face of the nozzle plate of the ink jet recording head. Thus the optimum wiping member can be selected from among a plurality of wiping members to achieve a good wiping effect in accordance with a change in the type of adhering substances (ink, fine particles of paper, dust, etc.) and a change in an adhering condition (an increase in ink adhesion caused by environmental changes, and an increase in ink adhesion caused by the length of time when the ink deposit is left unremoved).

BRIEF DESCRIPTION OF THE DRAWINGS

A more complete appreciation of the present invention and many of the attendant advantages thereof will be readily obtained as the same becomes better understood by referring to the following detailed description when considered in connection with the accompanying drawings, wherein.

DETAILED DESCRIPTION OF THE PREFERRED EMBODIMENTS

Preferred embodiments of this invention will be described with reference to the accompanying drawings.

Figure 1:
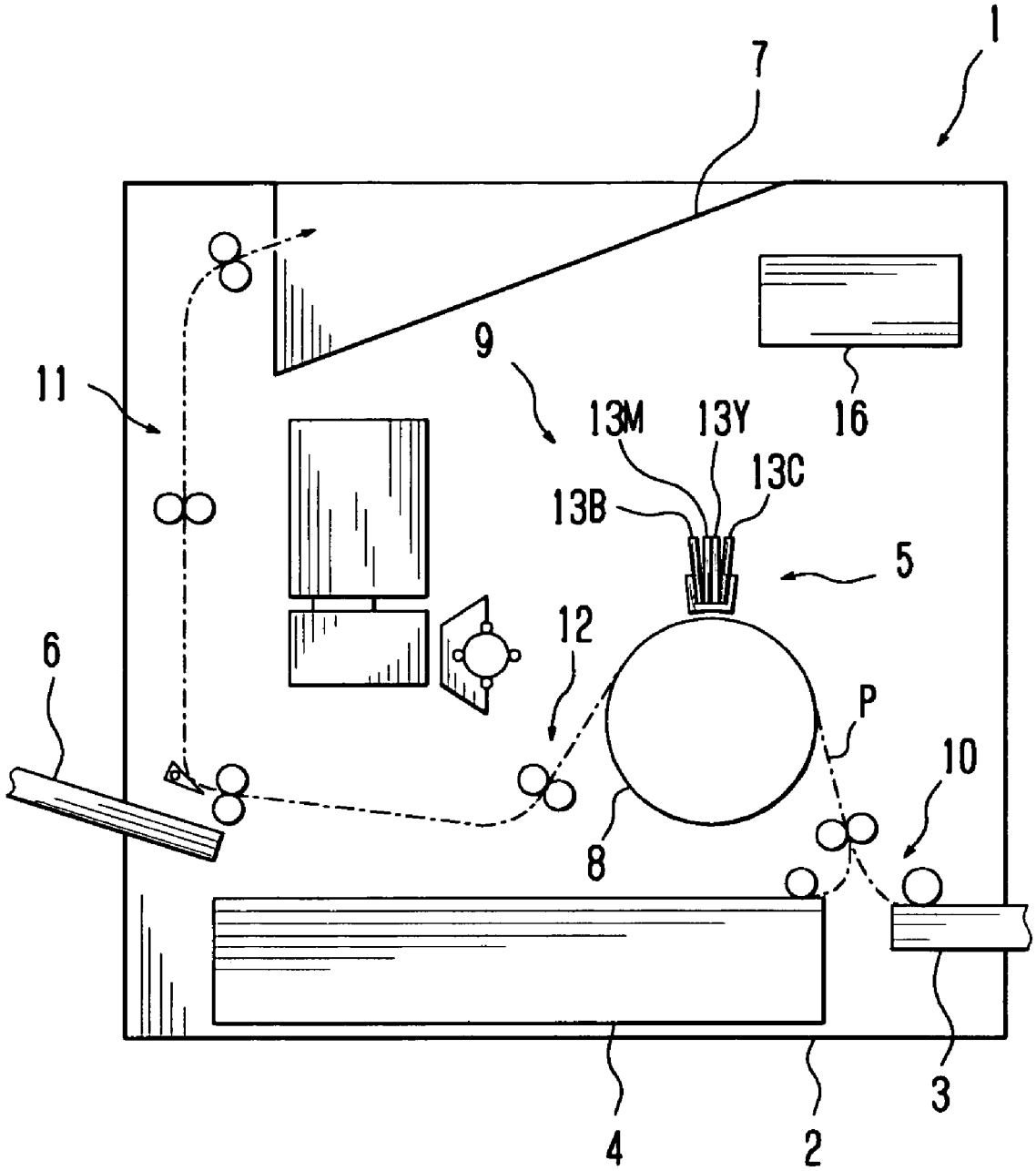
FIG. 1 is a longitudinal sectional side view schematically showing one embodiment of an ink jet recording apparatus of this invention.
Figure 2:
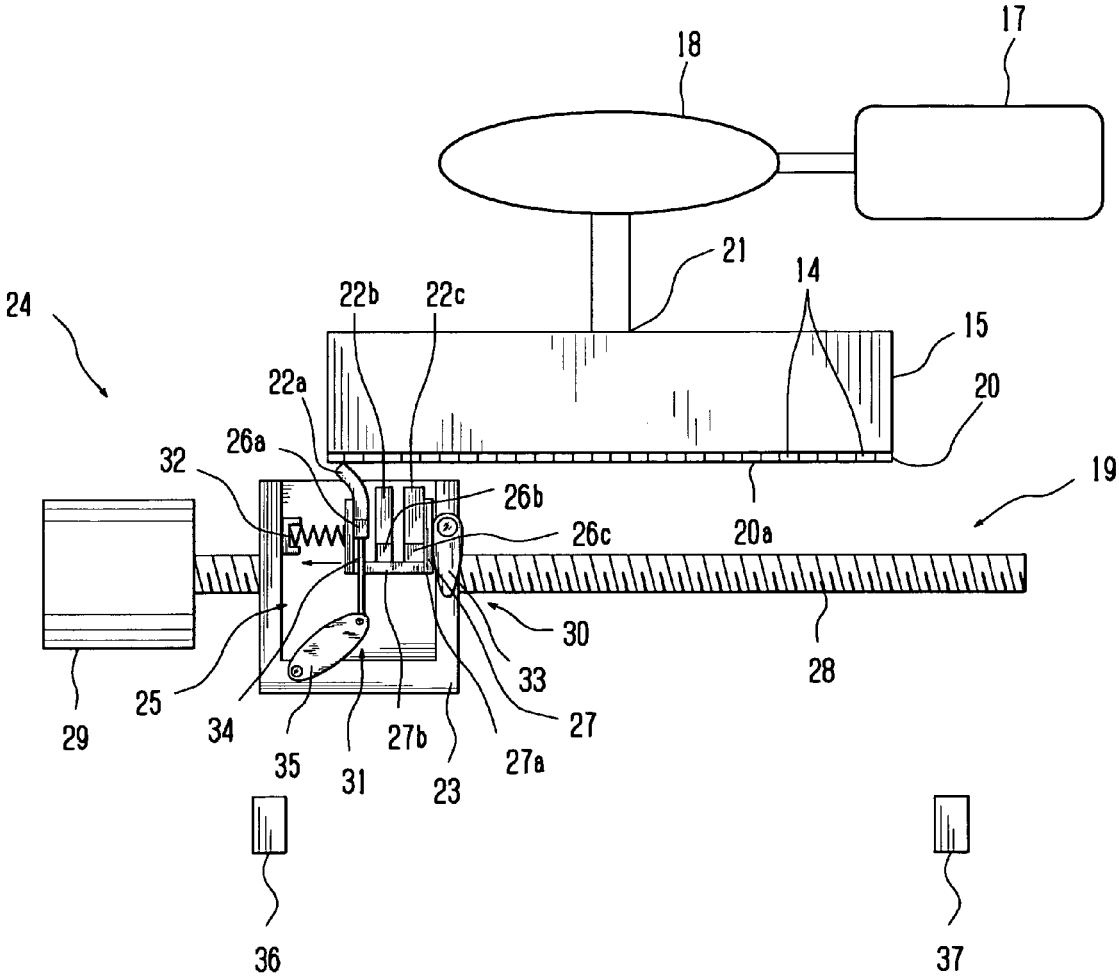
FIG. 2 is a schematic view showing a wiping mechanism provided with the ink jet recording apparatus.

FIG. 1 is a longitudinal sectional side view schematically showing one embodiment of an ink jet recording apparatus according to this invention. FIG. 2 is a schematic view showing a wiping mechanism of the ink jet recording apparatus. The ink jet recording apparatus of the present embodiment performs color printing on paper which is a recording medium. For the paper, ordinary paper, coated paper, OHP sheet, etc. are usable.

As shown in FIG. 1, an ink jet recording apparatus 1 has a sheet conveying route P in a chassis 2 for conveying a sheet. The sheet conveying route P is a route from a manual feed tray 3 or a paper cassette 4 to a lower sheet discharge tray 6 or an upper sheet discharge tray 7 through a printing section 5. The printing section 5 is comprised of a drum 8 and a printing unit 9.

In the manual feed tray 3 and the paper cassette 4, a sheet feed mechanism 10 is provided which feeds sheets stacked on the manual feed tray 3 or the paper cassette 5 one by one in a separating manner to the sheet conveying route P. In the sheet conveying route P is mounted a sheet conveying mechanism 11 for conveying the sheet fed by the sheet feed mechanism 10 from the manual feed tray 3 or the paper cassette 4 toward the lower sheet discharge tray 6 or the upper sheet discharge tray 7. The sheet conveying mechanism 11 has a sheet discharge mechanism 12 for discharging the printed paper from the printing section 5.

The printing section 5 performs printing, with the paper held on the outer periphery of the drum 8, by the printing unit 9 in accordance with a printing data while rotating the drum 8 at a predetermined speed. The printing unit 9 is provided with four nozzles units: 13C (cyan), 13Y (yellow), 13M (magenta), and 13B (black). The nozzle units 13C, 13Y, 13M and 13B are provided with an ink jet recording head 15 (see FIG. 2) which selectively ejects ink to the paper fed from the conveying mechanism 11, from a plurality of nozzles 14 (see FIG. 2).

The printing unit 9 is located above the drum 8 so that the nozzles 14 provided in the ink jet recording head 15 will face the drum 8 from above. The nozzle units 13C, 13Y, 13M and 13B are positioned around the drum 8 along the direction of drum rotation: 13C (cyan), 13Y (yellow), 13M (magenta) and 13B (black) in order of mention from the upstream side in the direction of rotation of the drum 8. Furthermore, the nozzle units 13C, 13Y, 13M and 13B are arranged so that the direction of arrangement of the nozzles 14 in the ink jet recording head 15 will be in parallel with the axial direction of the drum 8. The ink jet recording apparatus 1 has a control section 16 which drives to control each part of the ink jet recording apparatus 1.

As shown in FIG. 2, the ink jet recording apparatus 1 is provided with an ink feed mechanism 17 for feeding ink to the ink jet recording head 15, an ink pressure control section 18 for controlling the feed pressure of ink to be supplied from the ink feed mechanism 17, and a wiping mechanism 19 which is a maintenance mechanism for the maintenance of the ink jet recording head 15.

The ink jet recording head 15 is provided with a plurality of pressure chambers (not shown) for holding ink to be supplied from the ink feed mechanism 17, and a nozzle plate 20 forming a part of these pressure chambers and having the nozzles 14 which communicate with the pressure chambers. The ink jet recording head 15 thus structured performs printing on paper with drops of ink ejected from the pressure chambers through the nozzles 14 by utilizing volume changes in the pressure chambers.

The pressure chamber comprises: a plurality of grooves which are formed in a board, opening at the front and upper sides; a top plate which closes these grooves at the upper side; and the nozzle plate 20 which closes the plurality of grooves at the front side. The board with a plurality of grooves is formed by bonding two piezoelectric members each polarized in the direction of thickness of the board in such a manner that the direction of polarization will be opposite. The plurality of grooves in the board are formed along the direction of lamination of the piezoelectric members. The grooves are parallelly separated from one another by a side wall disposed between grooves. Inside of each groove is provided an electrode, which is formed by for instance an electroless nickel plating process. The board is provided with a wiring pattern for connection to the electrode.

In a top plate, a common ink chamber communicating with each pressure chamber and an ink supply port 21 for supplying ink to the common ink chamber are formed. To the common ink chamber, ink is supplied through the ink supply port 21 by means of the ink supply mechanism 17. Ink used in the present embodiment is a liquid-type ink such as water-color ink, oil-based ink, ultraviolet-curing ink, etc. The ink used in the present embodiment contains for instance pigments or dyes as color materials.

In the nozzle plate 20, a plurality of nozzles (through holes) 14 are formed through in the direction of plate thickness. In the nozzle plate 20, the surface in which the plurality of nozzles 14 are formed functions as a nozzle face 20*a*. The nozzles 14 are provided corresponding to the pressure chambers. Each pressure chamber communicates with the outside through the nozzle 14. The nozzle plate 20 is provided with an ink-repellent layer (not shown) having an ink-repellent characteristic. The ink-repellent layer is provided on the entire surface of the nozzle plate 20, including the peripheral surface of the nozzle 14, to thereby achieve the stabilized straightforward ejection of ink drops.

In the present embodiment, no protective member for the protection of the nozzle plate 20 is provided. It should be understood, however, that this invention is not to be limited thereto, and a protective member for example may be adopted. Adopting the protective member can prevent a failure in maintaining the basic characteristics of the recording head likely to be caused by a flaw or breakage of the nozzle plate 20. Furthermore, the protective member can prevent the occurrence of a damage, such as a flaw, in the nozzle plate 20 when adjusting a gap between the printing surface (paper) and the ink jet recording head 15. Furthermore, the protective member functions to protect the nozzle plate 20 in the case there is the likelihood that an external force will be applied to the nozzle plate 20 during for example the transport of the ink jet recording head 15.

The ink supply mechanism 17 has ink tanks (not shown) for holding cyan, yellow, magenta and black ink, and a filter (not shown) for removing foreign substances included in the ink held in the ink tanks. The ink supply mechanism 17 supplies the ink of a needed color to the ink jet recording head 15 of each of the nozzle units 13C, 13Y, 13M and 13B. At this time, the ink pressure control section 18 controls the supply pressure of ink to be supplied to the ink jet recording head 15, thereby enabling the adjustment of the position of ink liquid level in the nozzle 14.

The wiping mechanism 19 is provided with a plurality of wiping members 22*a*, 22*b* and 22*c* for wiping the nozzle plate 20 (nozzle face 20*a*), a wipe support member 23 for supporting the wiping members 22*a*, 22*b* and 22*c*, a moving mechanism 24 which movably supports the wipe support member 23 in the direction of arrangement of the nozzle 14 of the nozzle plate 20 and moves the wipe support member 23 along the nozzle plate 20, and a positioning mechanism 25 which positions the wiping members 22*a*, 22*b* and 22*c* in their contact positions in which the wiping members come into contact with the nozzle plate 20 while the wipe support member 23 is being moved along the nozzle plate 20 by the moving mechanism 24.

The wiping members 22*a*, 22*b* and 22*c* are formed in a shape of plate of an elastic material or a porous material. For example, the wiping members 22*a*, 22*b* and 22*c* are produced of a rubber material, such as an acrylonitrile-butadiene rubber (NBR) and a fluororubber (FPM). The wiping members 22*a*, 22*b* and 22*c* differ in thickness, hardness, material, porous density, wipe length (free length: length of free deflection), wiping depth, wiping speed, etc. That is, the wiping members 22*a*, 22*b* and 22*c* are so formed as to vary in the wiping force to be applied to the nozzle faces 20*a* (e.g., a contact pressure to be applied to the nozzle faces 20*a*). In the present embodiment, three wiping members for example are provided, but it should be noted that the number of these wiping members is not limited thereto. Furthermore, the wiping members 22*a*, 22*b* and 22*c* are formed to wipe the nozzle faces 20*a* with different wiping forces, but it also should be noticed that the wiping forces are not limited thereto. For example, the wiping members 22*a*, 22*b* and 22*c* may be formed so that at least one of the wiping forces against the nozzle faces 20*a* may vary.

The wipe support member 23 has wipe holders 26*a*, 26*b* and 26*c* for supporting the wiping members 22*a*, 22*b* and 22*c* respectively, and a wiper housing case 27 for holding the wipe holders 26*a*, 26*b* and 26*c*. The wiping members 22*a*, 22*b* and 22*c*, aligned along the direction of movement of the wipe support member 23, are removably housed in the wiper housing case 27. The wiper housing case 27 is supported by the wipe support member 23 so as to be movable along the direction of alignment of the wiping members 22*a*, 22*b* and 22*c*, that is, along the direction of movement of the wipe support member 23.

The wipe support member 23 is of a cartridge type, and is removable together with the wiper housing case 27 and the wiping members 22*a*, 22*b* and 22*c* from the ink jet recording apparatus 1. The wiper housing case 27 also is of a cartridge type, and is removably supported in the wipe support member 23. That is, the wipe holders 26*a*, 26*b* and 26*c* is removably supported in the wiper housing case 27, thereby enabling the replacement of the wiping members 22*a*, 22*b* and 22*c* in accordance with ink characteristics in the case where ink replacement (color and characteristics) is needed. In the present embodiment, therefore, the wipe support member 23, the wiper housing case 27, and the wiping members 22*a*, 22*b* and 22*c* are removable. However, it should be understood that the present embodiment is not limited thereto; for example, the wipe support member 23 may be unremovably fixed.

The moving mechanism 24 comprises: a guide screw 28 which supports the wipe support member 23, to guide and move the wipe support member 23 in the direction of arrangement of the nozzles 14; and a driving motor 29 which drives to rotate the guide screw 28. The moving mechanism 24 reciprocates the wipe support member 23 in the direction of arrangement of the nozzles 14 along the nozzle plate 20 by driving the driving motor 29 to change the direction of rotation of the guide screw 28.

The positioning mechanism 25 has a wiping member moving mechanism 30 which moves the wiping members 22*a*, 22*b* and 22*c* as far as a predetermined pressing position, and a pressing mechanism 31 which presses, against a contact position, the wiping members 22*a*, 22*b* and 22*c* which have been moved to the predetermined pressing position by the wiping member moving mechanism 30.

The wiping member moving mechanism 30 is comprised of a spring 32 mounted in the wiper housing case 27 for pressing the wiper housing case 27 rightward from the left in FIG. 2, and a cam 33 which is rotatably mounted in the wipe support member 23 and in contact with the wiper housing case 27 being pressed by the spring 32. The cam 33, driven to rotate by the control section 16, is moved in the direction of arrangement of the wiping members 22*a*, 22*b* and 22*c*, that is, in the direction of movement of the wipe support member 23.

The pressing mechanism 31 comprises a pressing member 34 for pressing the wiping members 22*a*, 22*b* and 22*c* into contact with the nozzle plate 20, and a cam 35 connected to the pressing member 34 and rotatably installed to the wipe support member 23. In the bottom 27*a* of the wiper housing case 27, a hole 27*b* is provided to allow the insertion of the pressing member 34. The hole 27*b*, which may, for example, be a long narrow hole in bottom 27*a* of the wiper case 27, is formed in such a manner that the wiping members 22*a*, 22*b* and 22*c* may be pressed from below by the pressing member 34. In the present embodiment, the wiper housing case 27 is moved by the wiping member moving mechanism 30 toward the pressing mechanism 31, to thereby move the wiping members 22*a*, 22*b* and 22*c* along the direction of arrangement; therefore it is possible to move the optimum wiping members 22*a*, 22*b* and 22*c* to the pressing position in which these wiping members will come into contact with the nozzle plate 20. There may be provided a plurality of special pressing mechanisms 31 respectively under the wiping members 22*a*, 22*b* and 22*c*. In this case, the wiping member moving mechanism 30 is not needed.

The pressing member 34 is installed so as to be vertically (in FIG. 2) moved in and out of the hole 27*b* of the wiper housing case 27. It is also so structured as to be insertable and removable through the hole 27*b* at the bottom 27*a* side. As the cam 35 is rotated by the control section 16, the pressing member 34 vertically (in FIG. 2) moves in and out of the hole 27*b*. With the movement of the pressing member 34, the wiping members 22*a*, 22*b* and 22*c* can be pressed to selectively push out the tips of the wiping members 22*a*, 22*b* and 22*c* into contact with the nozzle plate 20. Here, with positions of the wiping members 22*a*, 22*b* and 22*c* housed in the wiper housing case 27 being as housing positions (22*b* and 22*c* in FIG. 2), the positions of the wiping members 22*a*, 22*b* and 22*c* that have been pushed by the pressing member 34 out of the wiper housing case 27 into contact with the nozzle plate 20 are to be the contact positions (22*a* in FIG. 2).

The ink jet recording apparatus 1 has a home position sensor 36 whose output varies depending on whether or not the wipe support member 23 is in its home position, and an end position sensor 37 whose output varies depending on whether or not the wipe support member 23 is in the end position. The home position sensor 36 and the end position sensor 37 function as position detectors which detect the positions of the wiping members 22*a*, 22*b* and 22*c* in the wiping direction (from left to right in FIG. 2). In the present embodiment, the wiping direction is from left to the right in FIG. 2. It, however, should be understood that, in the present embodiment, the wiping direction is not limited thereto, but may be, for example, from right to left in FIG. 2.

The home position sensor 36 and the end position sensor 37 can be realized by for example a photo-interrupter, receiving by a light-receiving element the light emitted from a light-emitting element. The light-emitting and -receiving elements are oppositely positioned on both sides of a path of movement of the wipe support member 23. That is, the output of these light-emitting and -receiving elements varies with the passage or non-passage of the wipe support member 23 between these elements.

When executing maintenance operation, the moving mechanism 24 moves the wipe support member 23 from its home position to the end position in accordance with a change in the output of the home position sensor 36 and the end position sensor 37, and then returns the wipe support member 23 from the end position to its home position. While the wipe support member 23 is moved to the end position, the cam 35 of the pressing mechanism 31 is positioned to hold the tip of the wiping member 22*a* in contact with the nozzle plate 20. In this state, the wipe support member 23 is moved in the direction of wiping. While the wipe support member 23 returns to its home position after the wiping operation, the cam 35 of the pressing mechanism 31 is positioned such that the tips of the wiping members 22*a*, 22*b* and 22*c* do not contact the nozzle plate 20. Alternatively, the wipe support member 23 may be so structured as to move downward, to thereby move the tips of the wiping members 22*a*, 22*b* and 22*c* away from the nozzle plate 20.

In the present embodiment, the wipe support member 23 is timed to be reset to its home position in accordance with a change in the output of the end position sensor 37. It is to be understood, however, that the present embodiment is not limited thereto, and the wipe support member 23 may be so timed as to be reset to its home position, by, for example, controlling the travel of the wipe support member 23 in relation to a distance in the direction of arrangement of the nozzle 14.

Figure 3:
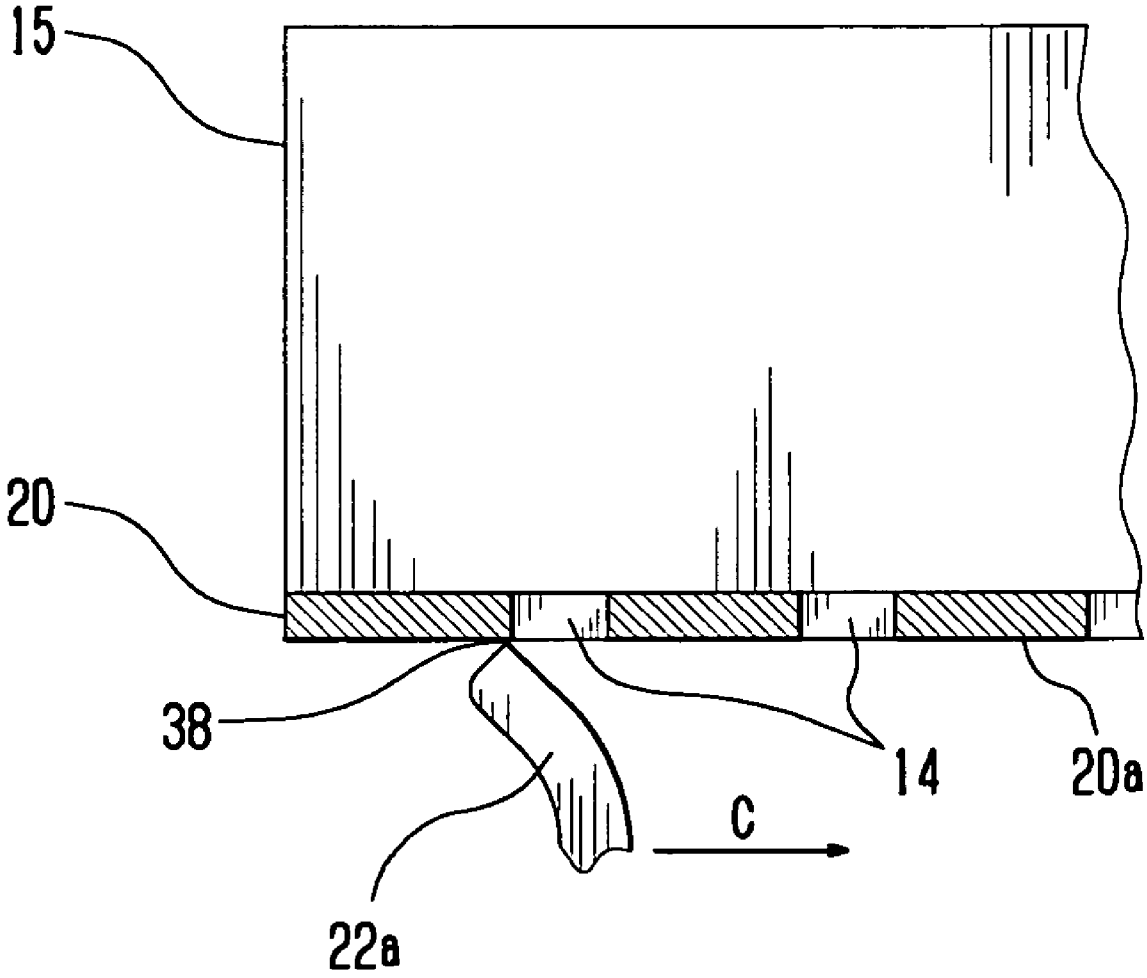
FIG. 3 is a schematic view showing the state of contact of a wiping member with a nozzle plate of an ink jet recording head of the ink jet recording apparatus.

Here, the structure of the tip of the wiping member 22 will be explained as an example. FIG. 3 is a schematic view showing the wiping member 22*a* which is in contact with the nozzle plate 20. As shown in FIG. 3, at the tip of the wiping member 22*a* is formed an edge portion 38 along a direction intersecting the direction of movement of the wipe support member 23. The wiping member 22*a* is supported in such a manner that the edge portion 38 will be pressed against the nozzle plate 20. The edge portion 38 of the wiping member 22*a* is pressed by an elastic force of its own against the nozzle plate 20. The wiping member 22*a* is being pressed in such a manner that its tip portion will be positioned at the rear side in the direction of wiping (the direction of arrow c in FIG. 3) in which the wipe support member 23 moves first when the wipe support member 23 is reciprocated by the moving mechanism 24.

Next, the home position of the wipe support member 23 of the wiping member 22*a* will be described. The wipe support member 23 is reciprocally movable along the direction of arrangement of the nozzle 14. Except during the execution of maintenance operation, however, the wipe support member 23 is waiting in its home position. The home position of the wipe support member 23 is a position in which for example the edge portion 38 of the tip of the wiping member 22*a* is off the nozzle plate 20. Here, FIG. 4 is an explanatory view explaining the home position of the wipe support member 23, and FIG. 5 is an explanatory view explaining the other home position (different from FIG. 4) of the wipe support member 23.

Figure 4:
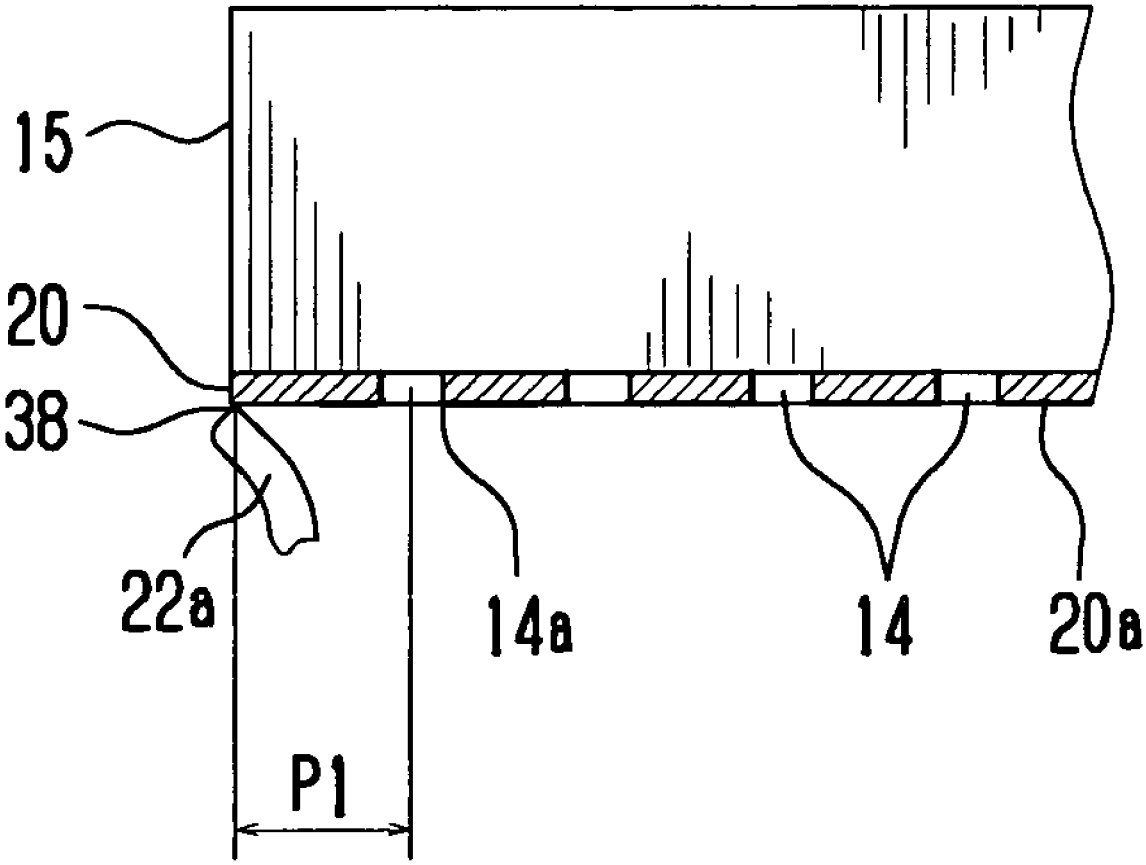
FIG. 4 is an explanatory view for explaining a home position of a wipe-supporting member.

For example, as shown in FIG. 4, the home position of the wipe support member 23 may be outside of the nozzle 14 where the edge portion 38 at the tip of the wiping member 22*a* will be in the outermost position in the direction of arrangement of the nozzle 14, and may be in a position where it is in contact with the nozzle plate 20. In FIG. 4, P1 indicates a distance, in the direction of arrangement of the nozzle 14, from the nozzle 14*a* to the contact position where the edge portion 38 of the wiping member 22*a* contacts the nozzle plate 20. P1 is set shorter than a distance from the nozzle 14*a* to one end (the left end in FIG. 4) of the nozzle plate 20 in the direction of arrangement of the nozzle 14.

Figure 5:
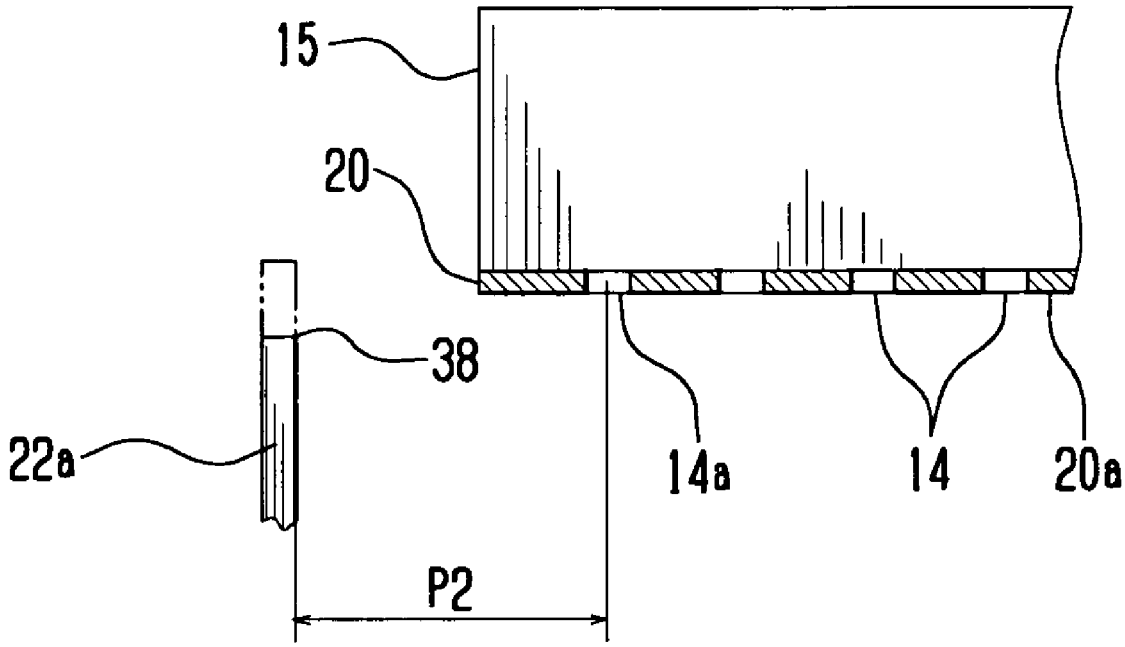
FIG. 5 is an explanatory view for explaining another home position of the wipe-supporting member.

Furthermore, for example, as shown in FIG. 5, the home position of the wipe support member 23 may be outside the nozzle 14*a* where the edge portion 38 of the wiping member 22*a* will be in the outermost position in the direction of arrangement of the nozzle 14, and may be in a position not opposite to the nozzle plate 20. In FIG. 5, P2 indicates a distance in the direction of arrangement of the nozzles 14 from the nozzle 14*a* to the edge portion 38 of the wiping member 22*a*. P2 is set longer than the distance from the nozzle 14*a* to one end (the left end in FIG. 5) of the nozzle plate 20 in the direction of arrangement of the nozzle 14.

In executing the maintenance operation of wiping, of the nozzle plate 20 of the ink jet recording head 15, the wiping member 22*a* is in contact with the nozzle plate 20 only when moved in a direction (from the left to the right in the direction of wiping in FIG. 2) of moving away from its home position.

When the wipe support member 23 is placed in its home position shown in FIG. 5, the wiping member 22*a* may be positioned for example in a position indicated by a solid line in FIG. 5, and also may be positioned in a position indicated by a dotted line in FIG. 5. Also when the wiping member 22*a* is in the position indicated by the dotted line in FIG. 5, the wiping member 22*a* is placed in a contact position in which the wipe support member 23 is in contact with the nozzle plate 20 while the wipe support member 23 is being moved by the moving mechanism 24 along the nozzle plate 20. In the present embodiment, the position indicated by the solid line in FIG. 5 is the home position of the wipe support member 23.

Figure 6:
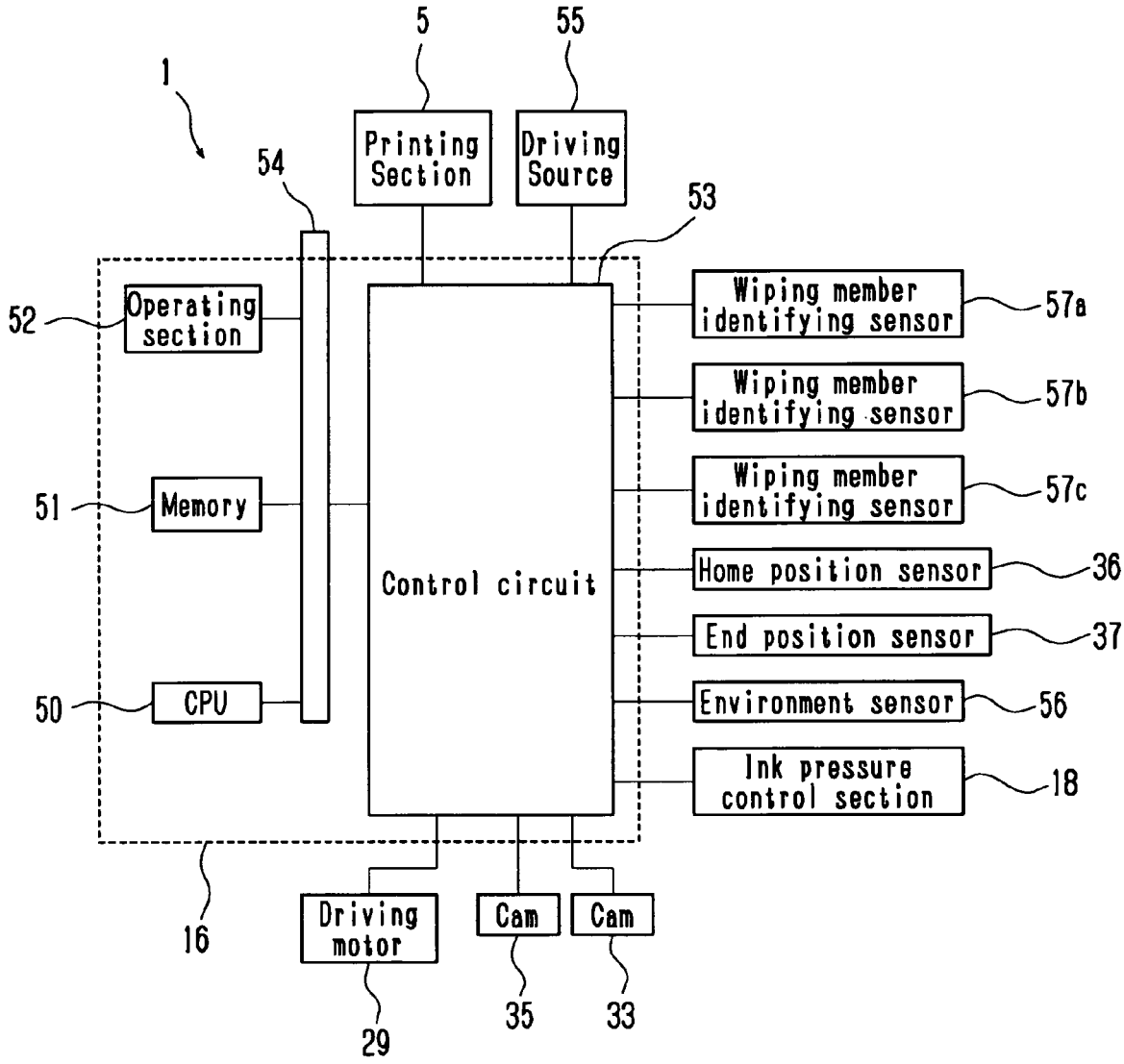
FIG. 6 is a block diagram showing the electric connection of each part of the ink jet recording apparatus.

FIG. 6 is a block diagram schematically showing an electric connection of each part of the ink jet recording apparatus 1. As shown in FIG. 6, the control section 16 of the ink jet recording apparatus 1 is comprised by connecting, through an I/O port 54, a CPU 50 which drives to control each part of the ink jet recording apparatus 1 by executing various kinds of control programs, a memory 51 such as a ROM for the storage of various kinds of control programs and a RAM which functions as a work area of the CPU 50, an operating section 52 which operates in accordance with the operator's operation, and a control circuit 53.

To the control circuit 53, are connected a printing section 5 (the ink jet recording head 15), a driving source 55, an ink pressure control section 18, a driving motor 29, a cam 33, a cam 35, a home position sensor 36, an end position sensor 37, an environment sensor 56 for detecting temperature and humidity, and wiping member identifying sensors 57*a*, 57*b* and 57*c* which identify the operating condition (whether operated or not) of the wiping members 22*a*, 22*b* and 22*c*. The driving source 55 is for driving the sheet feed mechanism 10 and the sheet conveying mechanism 11.

As the wiping member identifying sensors 57*a*, 57*b* and 57*c*, mechanical switches are used. For example, three mechanical switches are installed in the wiper housing case 27 correspondingly to the wiping members 22*a*, 22*b* and 22*c*. Thus it is possible to identify the wiping members 22*a*, 22*b* and 22*c* placed in the contact position, that is, in use for wiping, by detecting the on/off operation of these mechanical switches.

The control section 16 controls each part of the ink jet recording apparatus 1 to execute printing and maintenance operations. In the present embodiment, the maintenance operation is a wiping operation executed by the wiping mechanism 19. The control section 16 functions to perform the printing and maintenance operations in accordance with signals outputted from the operating section 52 operated by the operator's key operation.

In the memory 51 an area for the storage of various data to be referred to in executing the maintenance operation is provided. In the area are stored such data as cumulative number of counts of maintenance operation executed after the execution of preceding maintenance operation, cumulative unexecuted maintenance time after the execution of preceding maintenance operation, temperature history, humidity history, and number of printed sheets after the preceding maintenance operation. Further stored in the area are data referred to at the time of up-down motions of the tips of the wiping members 22*a*, 22*b* and 22*c* by the pressing mechanism 31, such as data of upward motion and data of downward motion relative to displacements. In addition, the memory 51 is provided with various counter areas for use in executing the maintenance operation. Furthermore, table data are stored for selecting the optimum wiping member from among a plurality of wiping members 22*a*, 22*b* and 22*c* in accordance with such data as cumulative number of counts of maintenance operation executed after the execution of the preceding maintenance operation, cumulative unexecuted maintenance time after the execution of the preceding maintenance operation, temperature history, humidity history, and number of printed sheets after the preceding maintenance operation.

Next, a selection processing for selecting the optimum wiping member from among the wiping members 22*a*, 22*b* and 22*c* from the condition of adhering substances on the nozzle plate 20 (the nozzle face 20*a*) will be explained. The wiping members 22*a*, 22*b* and 22*c* are formed, for example, of the same material (e.g., fluororubber). The wiping member 22*a* is 0.5 mm thick; the wiping member 22*b* is 1.0 mm thick; and the wiping member 22*c* is 2.0 mm thick.

A first selection processing will be explained. Upon receiving a command for the execution of wiping, the control section 16 refers to the memory 51 relative to data about the unexecuted wiping time after the preceding execution of wiping, and compares the data with a table data prepared, thereby selecting the optimum wiping member from among the wiping members 22*a*, 22*b* and 22*c*. That is, the control section 16 performs the function as the selecting means. The table data is stored so that when the unexecuted wiping time after the preceding execution of wiping operation is within one hour, the wiping member 22*a* will be selected; when the unexecuted wiping time exceeds one hour and within 8 hours, the wiping member 22*b* will be selected; and when the unexecuted wiping time exceeds 8 hours, the wiping member 22*c* will be selected. It is because the longer the unexecuted wiping time after the preceding wiping is, the firmer the adhering substance (residual ink) on the nozzle plate 20 dries/solidifies and accordingly the greater wiping force will be needed. When the wiping members 22*a*, 22*b* and 22*c* have the same hardness, length (free length: length of free deflection), wiping depth, and wiping speed, the wiping force will increase with an increase in the thickness of the wiping members 22*a*, 22*b* and 22*c*, gaining a higher wiping performance. It is to be noted that the selection of the wiping members 22*a*, 22*b* and 22*c* is not limited thereto; a similar wiping effect can be obtained even when the wiping member 22*a* has the hardness of 35 degrees, the wiping member 22*b* has the hardness of 60 degrees, and the wiping member 22*c* has the hardness of 80 degrees, or when the wiping member 22*a* is 7.0 mm long. (in free length), when the wiping member 22*b* is 5.5 mm long (in free length), and when the wiping member 22*c* is 3.0 mm long (in free length).

Next, a second selection processing will be explained. Upon receiving a command for execution of wiping, the control section 16 refers to the preceding environmental history (temperature and humidity) data of the memory 51, and compares the data with a table data prepared in advance in the memory 51, thus enabling the selection of the optimum wiping member from among the wiping members 22*a*, 22*b* and 22*c*. That is, the function as the selecting means will be executed. The table data is so stored that the wiping member 22*a* is selected when, for example, the environmental histories (temperature and humidity) after the preceding wiping operation are 25° C. and 50%; the wiping member 22*b* is selected in the case of 35° C. and 70%; and the wiping member 22*c* is selected in the case of 45° C. and 85%. Generally, it is known that the ink is apt to solidify because moisture attaches to the ink at high humidities. Also it is generally known that the ink becomes less viscous and hard to solidify at high temperatures. Therefore it is hard to determine the condition of adhering substances only from temperatures and humidities. The condition of the adhering substances varies with a combination of temperature and humidity. The environmental history (temperature and humidity) table data from the preceding operations is one example verified by experiments. When the wiping members 22*a*, 22*b* and 22*c* have the same hardness, length (free length: length of free deflection), wiping depth, and wiping speed, the wiping force increases with an increase in the thickness of the wiping members 22*a*, 22*b* and 22*c*, and therefore a high wiping performance is achieved. The selection of the wiping members is not limited to the example described above.

Next, a third selection processing will be explained. The control section 16, receiving a command for execution of wiping, refers to a data on the number of printed sheets from the preceding data in the memory 51, and compares the data with the table data prepared in advance in the memory 51, thus selecting the optimum wiping member from among the wiping members 22*a*, 22*b* and 22*c*. The table data is stored so that the wiping member 22*a* is selected for example when the number of A4-sized printed sheets from the preceding operation is within 500 sheets; the wiping member 22*b* is selected in the case of 500 up to 2000 sheets; and the wiping member 22*c* is selected in the case of 1000 sheets or over. Generally, the more the number of printed sheets increases, the more the paper dust tend to attach on the nozzle plate 20. Besides, with an increase in the amount of paper dust, adhering substances become likely to solidify in synergy with residual ink. Therefore, a greater wiping force is needed with an increase in the number of printed sheets from the preceding operation. The number of printed sheets from the preceding operation stated above is one example verified by experiments. When the wiping members 22*a*, 22*b* and 22*c* have the same hardness, length (free length: length of free deflection), wiping depth, and wiping speed, the thicker the wiping members 22*a*, 22*b* and 22*c* increase, the greater the wiping force becomes, resulting in a higher wiping performance. It should be noticed, however, that the selection of the wiping members 22*a*, 22*b* and 22*c* is not limited to the example stated above.

In the ink jet recording apparatus 1, the electric voltage is applied to an electrode corresponding to a pressure chamber from which the ink will be ejected in printing operation in accordance with printing data. A pair of side walls in the pressure chamber applied with the voltage, therefore, is so deflected to increase and then reduce the volume of the pressure chamber interior. With the change in the volume of the pressure chamber, a part of the ink drawn in the pressure chamber will be ejected as drops of ink from the nozzle 14.

In such a printing operation, the ink thus ejected sometimes remains around the nozzle 14. The residual ink, if dried/solidified, is likely to bend the direction of ejection or to block the nozzle 14, or to cause defective ink ejection. It is, therefore, necessary to remove the residual ink.

Figure 7:
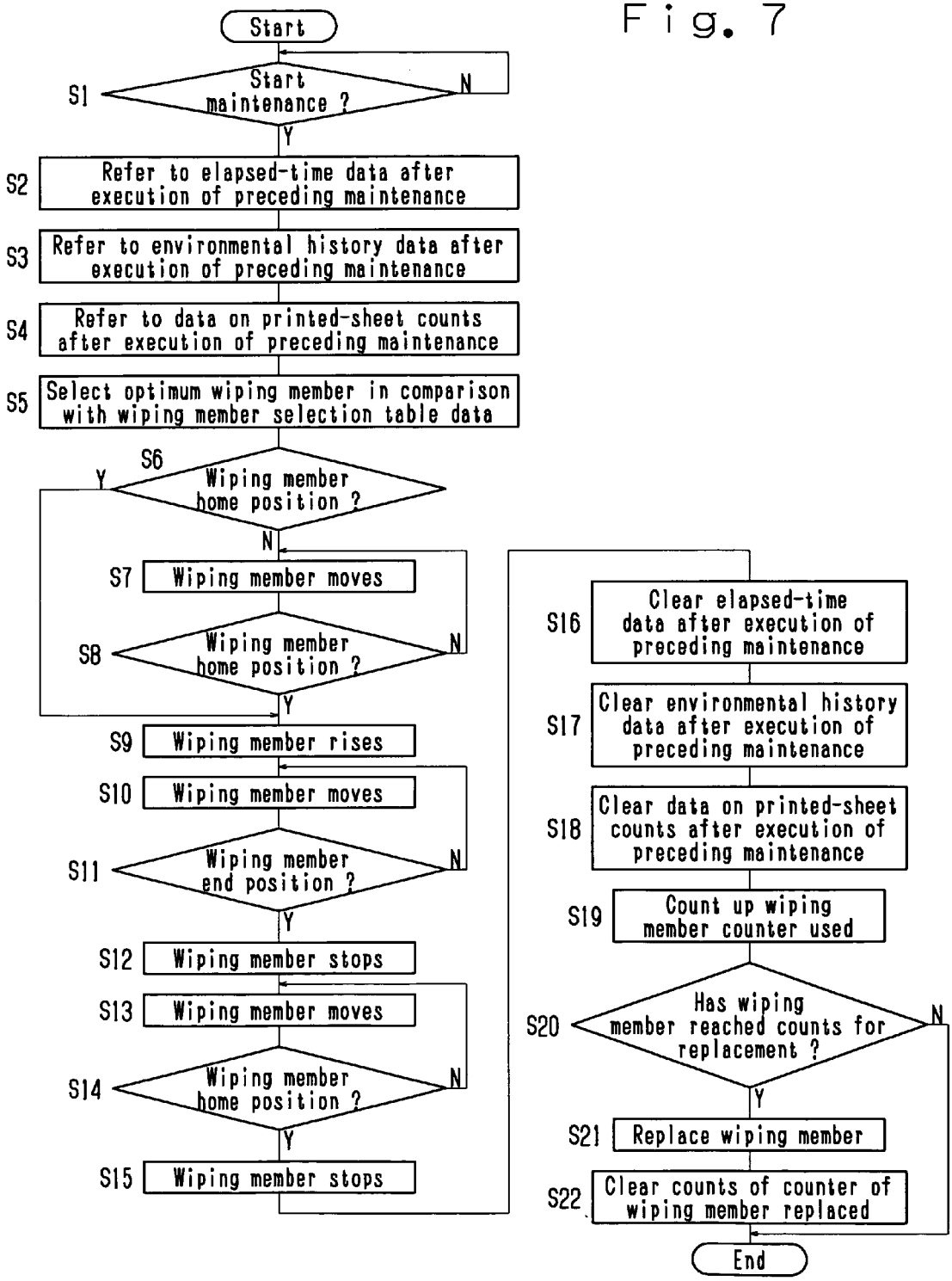
FIG. 7 is a flowchart showing the flow of maintenance processing.

In the ink jet recording apparatus 1 of the present embodiment, the wiping mechanism 19 performs maintenance operation to remove residual ink and foreign substances from the nozzle plate 20. Now, the maintenance operation by the wiping mechanism 19 will be explained. That is, the maintenance procedure to be executed by the control section 16 (CUP 50) in accordance with a program stored in the memory 51 will be described by referring to FIG. 7. FIG. 7 is a flowchart showing the flow of the maintenance procedure.

The wiping mechanism 19 is waiting until the execution of maintenance operation is declared. Upon judging the declaration of the execution of the maintenance operation, the control section 16 controls the wiping mechanism 19 to carry out the maintenance operation. The maintenance operation is executed when for example the execution of maintenance operation is declared by the operator's key manipulation.

As shown in FIG. 7, the control section 16 reads (in S2 to S4) data relative to the unexecuted maintenance time after the preceding maintenance, the temperature history, the humidity history, and the number of printed sheets after the preceding maintenance which are stored in the memory 51, when it is determined that the execution of maintenance operation has been declared (Y in S1), during standby for the declaration of execution of maintenance operation (N in S1). The control section 16 compares data concerning the unexecuted maintenance time after the execution of the preceding maintenance, the temperature history, the humidity history, and the number of printed sheets after the preceding maintenance, with table data for selecting the optimum wiping material from among a plurality of wiping members 22*a*, 22*b* and 22*c*. Thus the optimum wiping member (a wiping member selecting means) is selected; the cam 33 is controlled in accordance with data on the wiping member identifying sensors 57*a*, 57*b* and 57*c*, and the optimum wiping member thus selected is moved to the pressing position (S5).

The control section 16 then controls the moving mechanism 24 to set the optimum wiping member in its home position, thereby moving the wipe support member 28 to a position in which the home position sensor 36 will be on (S6 to S8). Next, the control section 16 drives the cam 35 to move the optimum wiping member up to the contact position until it determines that the optimum wiping member has been raised to the upper limit position in accordance with the UP data stored in the memory 51 (S9). After raising the optimum wiping member to the upper limit position in accordance with the UP data, the control section 16 drives the moving mechanism 24 to move the optimum wiping member toward wiping (from left to right in FIG. 2) until it determines that the optimum wiping member, i.e. the wipe support member 23, has reached its end position, in accordance with an output change from the end position sensor 37 (S10 to S11).

At this time, the edge portion 38 of the optimum wiping member comes into contact with the nozzle plate 20 as shown in FIG. 3. In this state, the wipe support member 23 is moved in the direction of wiping, thereby enabling the optimum wiping member to move as if rubbing against the nozzle plate 20. Thus it is possible to remove the residual ink or foreign substances from around the nozzles 14 of the nozzle plate 20. Furthermore, at this time, in the case of the wiping members 22*a*, 22*b* and 22*c* formed of an elastic or porous material, it is possible to prevent giving damage to the nozzle plate 20 if the wiping members 22*a*, 22*b* and 22*c* are moved with their edge portions 38 pressed against the nozzle plate 20.

The control section 16 stops driving the moving mechanism 24 (S12) when it is determined in accordance with an output change from the end position sensor 37 that the optimum wiping member, i.e. the wipe support member 23, has reached the end position (Y in S11). At the same time, the control section 16 drives the cam 35 to move the optimum wiping member downward until it is determined in accordance with the DOWN data stored in the memory 51 that the optimum wiping member has moved down to the lower limit position. Then, the control section 16 drives to control the moving mechanism 24 until it is determined in accordance with the output change from the home position sensor 36 that the optimum wiping member, i.e. the wipe support member 23, has been moved to its home position (S13 to S14).

When it is determined in accordance with the output change from the home position sensor 36 that the optimum wiping member, i.e. the wipe support member 23, has moved to its home position (Y in S14), the control section 16 stops driving the moving mechanism 24 (S15), clears a data concerning an unexecuted maintenance time after the preceding maintenance stored in the memory 51, temperature history, humidity history, and the number of printed sheets after the execution of the preceding maintenance operation, and increments a counter, or counts up the number of counts of maintenance operation (number of counts of wiping operation) executed by the optimum wiping member used (S16 to S19).

The control section 16 determines whether or not the number of counts registered has reached the preset number of counts of maintenance operation (S20). When it is determined that the number of counts registered has not reached the preset number of counts of maintenance operation (N in S20), the processing will end. When the number of counts registered is determined to have reached the preset number of counts of maintenance (Y in S20), the wiping members 22*a*, 22*b* and 22*c* that have reached the preset number of counts of maintenance will be replaced (S21). The number of counts of maintenance of the wiping members 22*a*, 22*b* and 22*c* thus replaced will be cleared (S22), ending the processing.

According to the present embodiment, a plurality of wiping members 22*a*, 22*b* and 22*c* which have different wiping forces to be applied to the nozzle face 20*a* are provided to remove ink and foreign substances remaining on the nozzle face 20*a* of the nozzle plate 20 of the ink jet recording head 15. It is possible to select the optimum wiping member without increasing the number of counts of wiping operation and accordingly to achieve a good wiping effect, by selecting the optimum wiping member from among the plurality of wiping members 22*a*, 22*b* and 22*c* according to changes in the kind of adhering substances (ink, fine particles of paper, dust, etc.) and adhering condition (an increase in ink adhesion caused by environmental changes, and an increase in ink adhesion by the length of time when ink deposit is left unremoved). The wiping effect is not improved by increasing the number of counts of wiping operation; therefore it is possible to increase the life of the wiping member and maintain a good wiping performance of the wiping members for a prolonged period of time. Consequently, it is possible to maintain a good ink ejection performance at the time of printing, to thereby improve printing reliability.

When the ink jet recording head 15 has been replaced or when the ink to be supplied thereto has been changed, for example from the water-color ink to the oil-based ink, from the oil-based ink to the UV ink (the ultraviolet-curing ink), etc., there will occur such a trouble as ink solidification and accordingly defective printing if ink remaining unchanged is used. Also if new ink and the unchanged wiping members 22*a*, 22*b* and 22*c* are used, the wiping members 22*a*, 22*b* and 22*c* are likely to swell and the components of these wiping members 22*a*, 22*b* and 22*c* will melt out to alter ink performance. Furthermore, it will become necessary to use the wiping members 22*a*, 22*b* and 22*c* made of such a material as is capable of responding to the condition of the nozzle plate surface (the presence or absence of an ink-repellent film, or the strength of the ink-repellent film). Therefore, as in the ink jet recording apparatus 1 of the present embodiment, the wiping members 22*a*, 22*b* and 22*c*, when configured removable, will be replaceable.

According to the present embodiment, the wiping mechanism 19 includes: the wipe support member 23 supporting a plurality of wiping members 22*a*, 22*b* and 22*c*; the moving mechanism 24 supporting the wipe support member 23 movable along the nozzle face 20*a*, and moving the wipe support member 23 thus supported, along the nozzle face 20*a*; and the positioning mechanism 25 for positioning the optimum wiping member selected by the wiping member selecting means, in a contact position in which the optimum wiping member comes into contact with the nozzle face 20*a*, in the state that the wipe support member 23 is being moved along the nozzle face 20*a* by the moving mechanism 24. It is therefore possible to achieve a good wiping effect without complicating the configuration of the wiping mechanism 19.

Furthermore, according to the present embodiment, the positioning mechanism 25 has the wiping member moving mechanism 30 for moving the optimum wiping member to a predetermined pressing position, and the pressing mechanism 31 for pressing toward the contact position the optimum wiping member thus moved to the predetermined pressing position by the wiping member moving mechanism 30. Therefore, a good wiping effect is obtainable without complicating the configuration of the positioning mechanism 25. Also when the positioning mechanism 25 has a plurality of pressing mechanisms 31 for pressing a plurality of wiping members 22*a*, 22*b* and 22*c* each toward the contact position, it is possible to achieve a good wiping effect without complicating the configuration of the positioning mechanism 25.

Furthermore, according to the present embodiment, a plurality of wiping members 22*a*, 22*b* and 22*c* have, on their tips, the edge portion 38 along the direction intersecting the direction of movement. The positioning mechanism 25 also functions to position the optimum wiping member in a contact position so that the edge portion 38 of the optimum wiping member will come into contact with the nozzle face 20*a*. It is therefore possible to enhance the wiping performance of the wiping members 22*a*, 22*b* and 22*c* without complicating their configuration.

Furthermore, according to the present embodiment, a plurality of wiping members 22*a*, 22*b* and 22*c* are formed of an elastic material. The positioning mechanism 25 functions to position the optimum wiping member in such a manner that the edge portion 38 may be pressed toward the nozzle face 20*a* by the elastic force of the optimum wiping member. Therefore it is possible to further enhance the wiping performance of the wiping members 22*a*, 22*b* and 22*c* without complicating the configuration of the positioning mechanism 25.

Furthermore, according to the present embodiment, a plurality of wiping members 22*a*, 22*b* and 22*c* are formed so that the wiping force to be applied to the nozzle face 20*a* may vary. Therefore, it becomes possible to move the optimum wiping member into contact with the nozzle face 20*a* of the nozzle plate 20 correspondingly to a change in the kind of adhering substances and adhering condition and also to maintain a good wiping effect for a prolonged period.

Furthermore, according to the present embodiment, a plurality of wiping members 22*a*, 22*b* and 22*c*, being formed of an elastic material, will never impair the nozzle face 20*a* of the nozzle plate 20 if firmly pressed into contact with the nozzle face 20*a*.

Furthermore, according to the present embodiment, a plurality of wiping members 22*a*, 22*b* and 22*c*, being formed of a porous material, will never impair the nozzle face 20*a* of the nozzle plate 20 if firmly pressed into contact with the nozzle face 20*a*.

Furthermore, according to the present embodiment, a plurality of wiping members 22*a*, 22*b* and 22*c*, being removably formed in relation to the wipe support member 23, can be replaced according to ink characteristics in the case when the ink needs a change (in color and characteristic).

Furthermore, according to the present embodiment, since the wipe support member 23 are removably formed in relation to the moving mechanism 24, a plurality of wiping members 22*a*, 22*b* and 22*c* can easily be replaced by replacing the wipe support member 23.

Furthermore, according to the present embodiment, the wipe selecting means selects the optimum wiping member in accordance with an elapsed time after the execution of the preceding wiping operation. It is therefore possible to properly select the optimum wiping member in accordance with a change in the type of adhering substances and adhering condition, and consequently to gain a good wiping effect.

Furthermore, according to the present embodiment, the wiping member selecting means selects the optimum wiping member on the basis of an environmental history after the execution of the preceding wiping operation, and therefore it is possible to properly select the optimum wiping member in accordance with a change in the kind of adhering substances and adhering condition, and accordingly to obtain a good wiping effect.

Furthermore, according to the present embodiment, the wiping member selecting means selects the optimum wiping member in accordance with the number of counts of printed sheets after the execution of the preceding wiping operation. It is therefore possible to properly select the optimum wiping member in accordance with a change in the kind of adhering substances and adhering condition, and consequently to obtain a good wiping effect.

Obviously, numerous modifications and variations of the present invention are possible in light of the above teachings. It is therefore to be understood that within the scope of the appended claims, the invention may be practiced otherwise than as specifically described herein.

What is claimed is:

1. An ink jet recording head maintenance apparatus for an ink jet recording head which includes a nozzle face having a plurality of nozzles that eject ink as drops, said maintenance apparatus comprising:

a plurality of individual wiping members, each of which is individually selectable to wipe the nozzle face independently, and at least one of which is formed to apply a different wiping force to the nozzle face than another of the wiping members;

a wiping member selecting mechanism for selecting one of the individual wiping members; and a wiping mechanism for wiping the nozzle face with the selected individual wiping member.

2. An ink jet recording head maintenance apparatus according to claim 1, wherein the wiping mechanism includes:

a wipe support member supporting the plurality of wiping members;

a moving mechanism which movably supports the wipe support member to be movable along the nozzle face; and a positioning mechanism for positioning the selected individual wiping member in a contact position in which the selected individual wiping member comes into contact with the nozzle face while the wipe support member is moved along the nozzle face by the moving mechanism.

3. An ink jet recording head maintenance apparatus according to claim 2, wherein the positioning mechanism includes:

a wiping member moving mechanism for moving the selected individual wiping member to a predetermined pressing position; and a pressing mechanism for pressing, toward the contact position, the selected individual wiping member moved to the predetermined pressing position.

4. An ink jet recording apparatus, comprising:

a conveying mechanism for conveying a recording medium;

the ink jet recording head, which ejects ink from the nozzles to the recording medium being conveyed by the conveying mechanism;

a control section for controlling the conveying mechanism and the ink jet recording head in accordance with printing data; and an ink jet recording head maintenance apparatus according to claim 3.

5. An ink jet recording head maintenance apparatus according to claim 2, wherein each of the individual wiping members comprises at a tip thereof an edge portion extending along a direction intersecting a direction of movement; and wherein the positioning mechanism positions the selected individual wiping member in the contact position so that the edge portion of the selected individual wiping member contacts with the nozzle face while the wipe support member is moved along the nozzle face.

6. An ink jet recording head maintenance apparatus according to claim 5, wherein the plurality of wiping members are formed of an elastic material; and wherein the positioning mechanism positions the selected individual wiping member in the contact position so that the edge portion thereof is pressed against the nozzle face by elastic force of the selected individual wiping member.

7. An ink jet recording apparatus, comprising:

a conveying mechanism for conveying a recording medium;

the ink jet recording head, which ejects ink from the nozzles to the recording medium being conveyed by the conveying mechanism;

a control section for controlling the conveying mechanism and the ink jet recording head in accordance with printing data; and an ink jet recording head maintenance apparatus according to claim 6.

8. An ink jet recording apparatus, comprising:

a conveying mechanism for conveying a recording medium;

ink jet recording head, which ejects ink from the nozzles to the recording medium being conveyed by the conveying mechanism;

a control section for controlling the conveying mechanism and the ink jet recording head in accordance with printing data; and an ink jet recording head maintenance apparatus according to claim 5.

9. An ink jet recording head maintenance apparatus according to claim 2, wherein the plurality of wiping members are removable from the wipe support member.

10. An ink jet recording head maintenance apparatus according to claim 2, wherein the wipe support member is removable from the moving mechanism.

11. An ink jet recording apparatus, comprising:

a conveying mechanism for conveying a recording medium;

the ink jet recording head, which ejects ink from the nozzles to the recording medium being conveyed by the conveying mechanism;

a control section for controlling the conveying mechanism and the ink jet recording head in accordance with printing data; and an ink jet recording head maintenance apparatus according to claim 2.

12. An ink jet recording head maintenance apparatus according to claim 1, wherein each of the individual wiping members is so formed as to apply a different wiping force against the nozzle face than any other of the individual wiping members.

13. An ink jet recording head maintenance apparatus according to claim 1, wherein the plurality of wiping members are formed of an elastic material.

14. An ink jet recording head maintenance apparatus according to claim 1, wherein the plurality of wiping members are formed of a porous material.

15. An ink jet recording head maintenance apparatus according to claim 1, wherein the wiping member selecting mechanism selects said one of the individual wiping members in accordance with an elapsed time after execution of a preceding wiping operation.

16. An ink jet recording apparatus, comprising:

a conveying mechanism for conveying a recording medium;

the ink jet recording head, which ejects ink from the nozzles to the recording medium being conveyed by the conveying mechanism;

a control section for controlling the conveying mechanism and the ink jet recording head in accordance with printing data; and the ink jet recording head maintenance apparatus according to claim 1.

17. An ink jet recording head maintenance apparatus for an ink jet recording head which includes a nozzle face having a plurality of nozzles that eject ink as drops, said maintenance apparatus comprising:

a plurality of wiping members for wiping the nozzle face of the ink jet recording head, at least one of which is formed to apply a different a wiping force to the nozzle face than another of the wiping members;

a wiping member selecting mechanism for selecting one of the wiping members for wiping the nozzle face; and a wiping mechanism for wiping the nozzle face with the selected wiping member;

wherein the wiping member selecting mechanism selects the one of the wiping members in accordance with an environmental history after execution of a preceding wiping operation.

18. An ink jet recording head maintenance apparatus for an ink jet recording head which includes a nozzle face having a plurality of nozzles that eject ink as drops, said maintenance apparatus comprising:

a plurality of wiping members for wiping the nozzle face of the ink jet recording head, at least one of which is formed to apply a different a wiping force to the nozzle face than another of the wiping members;

a wiping member selecting mechanism for selecting one of the wiping members for wiping the nozzle face; and a wiping mechanism for wiping the nozzle face with the selected wiping member;

wherein the wiping member selecting mechanism selects the one of the wiping members in accordance with a number of sheets printed after execution of a preceding wiping operation.

* * * * *